US008217858B2

(12) United States Patent
Onishi et al.

(10) Patent No.: US 8,217,858 B2
(45) Date of Patent: Jul. 10, 2012

(54) IMAGE DISPLAY APPARATUS

(75) Inventors: Toshikazu Onishi, Sagamihara (JP); Tsuyoshi Takegami, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 12/985,699

(22) Filed: Jan. 6, 2011

(65) Prior Publication Data

US 2011/0169719 A1 Jul. 14, 2011

(30) Foreign Application Priority Data

Jan. 8, 2010 (JP) ..... 2010-003028

(51) Int. Cl.
*G09G 3/20* (2006.01)

(52) U.S. Cl. ..... 345/55; 345/77; 345/212

(58) Field of Classification Search ..... 345/77, 345/84, 204, 212
See application file for complete search history.

(56) References Cited

U.S. PATENT DOCUMENTS

2005/0269936 A1 12/2005 Takada
2006/0087219 A1 4/2006 Taniguchi et al.
2011/0148946 A1* 6/2011 Hiroike ..... 345/690

FOREIGN PATENT DOCUMENTS

EP 2071606 A2 6/2009
JP 2006-127794 A 5/2006

* cited by examiner

*Primary Examiner* — Amare Mengistu
*Assistant Examiner* — Premal Patel
(74) *Attorney, Agent, or Firm* — Canon USA Inc IP Division

(57) ABSTRACT

An image display apparatus includes a rear plate including electron emitting devices each including a pair of electrodes and an electron emitting unit, first wirings each interconnecting electrodes in one of the pair of electrodes of the electron emitting devices arrayed at the same row, second wirings each interconnecting electrodes in another of the pair of electrodes of the electron emitting devices arrayed at the same column and higher in resistance than the first wirings, an insulating layer covering the second wirings, and resistive films connected to the first wirings and partially overlapping with the second wirings to cover the insulating layer, and having surface resistance set to $10^8\Omega/\square$ or more. The resistive films are connected to the first wirings at portions not overlapping with the second wirings, and a length L of the resistive film between a portion of the resistive film connected to the first wiring and a portion overlapping with the second wiring satisfies a relationship.

2 Claims, 6 Drawing Sheets

IMAGE DISPLAY APPARATUS

BACKGROUND OF THE INVENTION

1. Field of the Invention

The present invention relates to an image display apparatus that includes a resistive film.

2. Description of the Related Art

Studies have been conducted on an image display apparatus that includes a rear plate and a face plate disposed to be opposed to each other with space of several millimeters: the rear plate including a plurality of electron emitting devices interconnected by wirings, and the faceplate including an anode for accelerating electrons emitted from the electron emitting devices and a light emitting member irradiated with the accelerated electrons to emit light. In the image display apparatus of this type, there is concern over electric discharging between the anode and the electron emitting devices. As countermeasures against the electric discharging, Japanese Patent Application Laid-Open No. 2006-127794 discusses a configuration where a conductive member excluding an electron emitting unit on an electron source substrate is covered with an insulating member. Furthermore, a configuration, whereby the insulating member covering the conductive member is in turn covered with a resistive member, is also discussed.

In the technology discussed in Japanese Patent Application Laid-Open No. 2006-127794, the resistive member and the conductive member are stacked together via the insulating member. This necessitates suppression of ineffective power consumption caused by charge and discharge currents based on a capacitance between the resistive member and the conductive member.

SUMMARY OF THE INVENTION

The present invention is directed to an image display apparatus capable of reducing power consumption.

According to an aspect of the present invention, an image display apparatus includes: a rear plate including a plurality of electron emitting devices each including a pair of electrodes and an electron emitting unit located between the pair of electrodes, and arrayed in a matrix, a plurality of first wirings each configured to interconnect electrodes in one of the pair of electrodes of the electron emitting devices arrayed at the same row among the plurality of electron emitting devices, a plurality of second wirings each configured to interconnect electrodes in another of the pair of electrodes of the electron emitting devices arrayed at the same column among the plurality of electron emitting devices and higher in resistance than the first wirings, an insulating layer configured to cover the second wirings, and resistive films connected to the first wirings and partially overlapping with the second wirings to cover the insulating layer, and having surface resistance set to $10^8\Omega/\square$ or more; a potential supply unit configured to supply a first potential V1 and a second potential V2 different from the first potential V1 respectively to the first wirings and the second wirings; and a face plate including an anode set at a potential higher than the first potential and the second potential, and light emitting members to be irradiated with electrons emitted from the electron emitting devices to emit light. In this case, the resistive films are connected to the first wirings at portions not overlapping with the second wirings, and a length L of the resistive film between a portion of the resistive film connected to the first wiring and a portion overlapping with the second wiring satisfies the following relationship:

$$L \geqq (\mu(|V1-V2|)t)^{1/2}$$

μ: electron mobility of the resistive film t: period of time of supplying the potential V1 and the potential V2

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
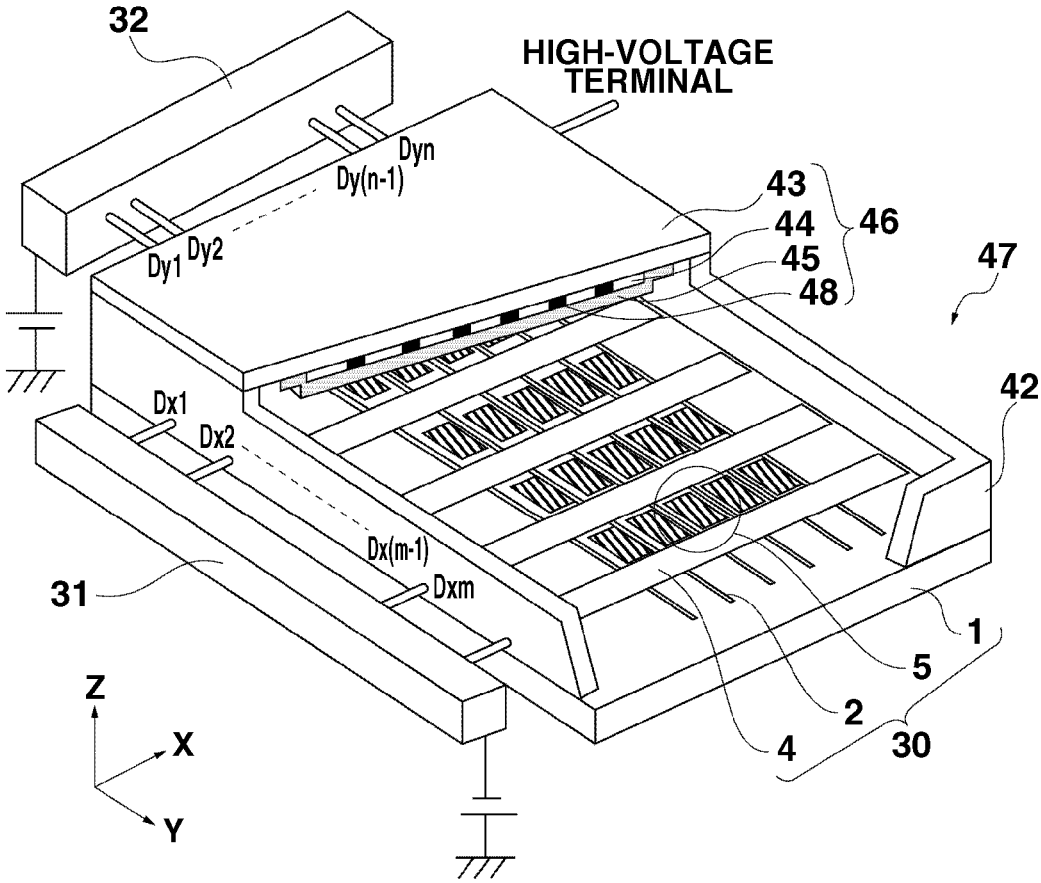
FIG. 1 is a perspective view illustrating an image display apparatus according to an exemplary embodiment of the present invention.
Figure 2A:
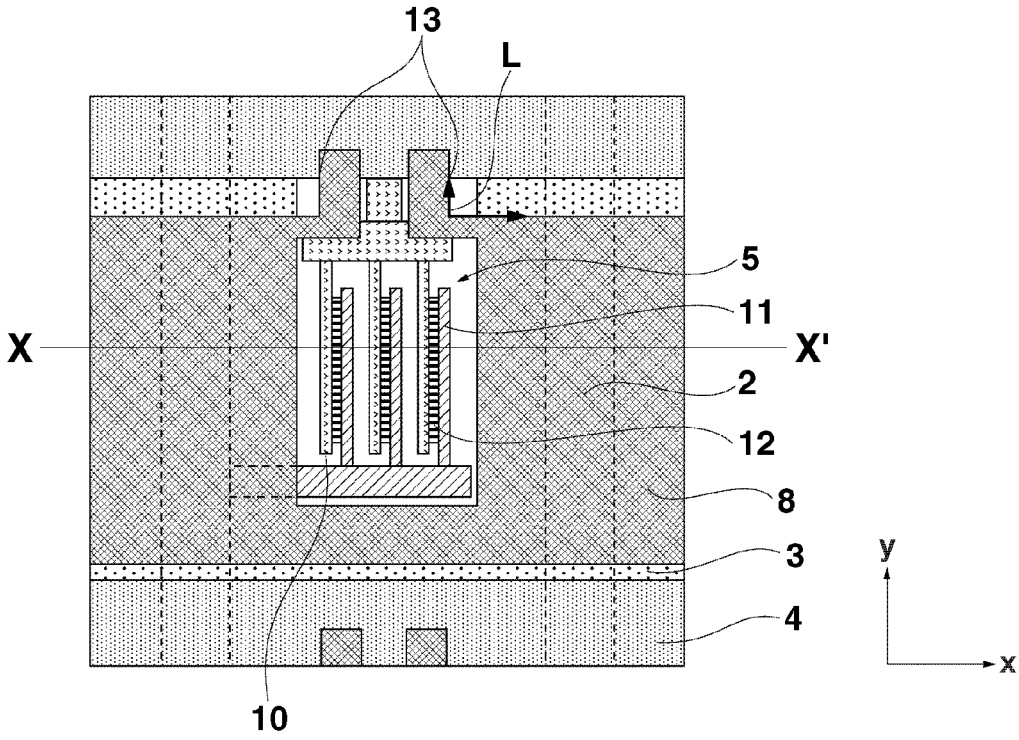
FIGS. 2A and 2B are plan views respectively illustrating an example of an electron emitting device according to the exemplary embodiment and an example of an electron emitting device according to a comparative example.

FIG. 1 is a partially-cutout perspective view illustrating an internal configuration of an image display apparatus according to an exemplary embodiment of the present invention. FIG. 2A illustrates, in partial enlargement, one of electron emitting devices 5 of the image display apparatus illustrated in FIG. 1.

As illustrated in FIG. 1, the image display apparatus 47 includes a face plate 46 and a rear plate 30 interconnected via a frame 42, and potential supply units 31 and 32 connected to a row wiring 4 and a column wiring 2 of the rear plate 30 described below and configured to supply, to the respective wring lines, a potential V1 that is a first potential and a potential V2 that is a second potential different from the potential V1.

The face plate 46 includes a front substrate 43, a plurality of light emitting members 44 arranged on the front substrate 43, and an anode 45 set at a potential higher than the electron emitting devices 5 to accelerate electrons emitted from the electron emitting devices 5 described below. The light emitting members 44 are irradiated with the electrons emitted from the electron emitting devices 5 to emit light.

The rear plate 30 includes a back substrate 1, the plurality of electron emitting devices 5 arranged in a matrix on the back substrate 1, the row wirings 4 constituting a plurality of first wirings, and the column wirings 2 constituting a plurality of second wirings. As illustrated in FIG. 2A, each electron emitting device 5 includes a cathode 10 and a gate 11 that constitute a pair of electrodes, and an electron emitting unit 12 located between the pair of electrodes.

Each of the plurality of row wirings 4 interconnects cathodes 10 each of which is one of a pair of electrodes of each electron emitting device 5 arrayed on the same row in the plurality of electron emitting devices 5 arrayed in the matrix. Each of the plurality of column wirings 2 interconnects gates 11 each of which is the other of the pair of electrodes of each electron-emitter electrode 5 arrayed on the same column in the plurality of electron emitting devices 5 arrayed in the matrix.

The column wiring 2 is higher in resistance than the row wiring 4, and covered with an insulating layer 3.

In the image display apparatus, generally, there are differences in length of a screen and in number of arrayed pixels between a vertical side and a horizontal side of a screen. Thus, the wirings for interconnecting the plurality of electron emitting devices arrayed corresponding to pixels differ from one another in length and width according to arrangement of the plurality of electron emitting devices, resulting in different resistance values. In the present exemplary embodiment, the column wiring 2 is higher in resistance than the row wiring 4. However, the row wiring 4 can be higher in resistance than the column wiring 2. What is important is that the highly-resistive wiring is covered with the insulating layer 3.

Covering of the column wiring 2 with the insulating layer 3 can suppress electric discharging between the anode 45 and the column wiring 2 (can suppress direct falling of electric discharging on the column wiring 2) even when unforeseen electric discharging occurs between the face plate 46 and the rear plate 30. As a result of suppressing electric discharging between the highly-resistive column wiring 2 and the anode 45, deterioration of all the electron emitting devices 5 connected to the column wiring 2, in other words, generation of line defects, can be prevented. This is described below in detail.

When electric discharging occurs between the row wiring 4 or the column wiring 2 and the anode 45, a potential at the wiring rises up to a voltage value determined by a product of a discharge current flowing through the wiring where the electric discharging has occurred and a resistance value of the wiring. The column wiring 2 is higher in resistance than the row wiring 4, and hence a potential rise is larger when the discharge current flows through the column wiring 2. Thus, when the discharge current flows through the column wiring 2, all the electron emitting devices 5 connected to the column wiring 2 are set at high potentials, greatly deteriorating electron emission characteristics, which generates "line defects". However, according to the configuration of the present exemplary embodiment, falling of electric discharging on the highly-resistive column wiring 2 can be suppressed. As a result, line defects can be suppressed.

In the configuration of the present exemplary embodiment, the image display apparatus includes a resistive film 8 connected to the row wiring 4 that is the first wiring, and partially overlaps with the column wiring 2 that is the second wiring to cover the insulating layer 3. The resistive film 8 is connected to the row wiring 4 that is the first wiring at a portion not overlapping with the column wiring 2. In FIG. 2A, the resistive film 8 is connected to the row wiring 4 at connection portions 13 that are parts of the resistive film 8. A length L of the resistive film between the connection portion 13 of the resistive film 8 to the row wiring 4 that is the first wiring, and the portion overlapping with the column wiring 2 satisfies a relationship of $L \geqq (\mu(|V1-V2|)t)^{1/2}$ (hereinafter, may be referred to as an expression 1), where μ denotes electron mobility (hereinafter, mobility) of the resistive film 8, V1 and V2 denote potentials respectively supplied from the potential supply units 31 and 32 to the row wiring 4 that is the first wiring and the column wiring 2 that is the second wiring, and t denotes a period of time during which the potentials V1 and V2 are supplied. In the present exemplary embodiment, as illustrated in FIG. 2A, to satisfy the relationship, the connection portions 13 of the resistive film 8 to the row wiring 4 are shifted from the column wiring 2 to prevent overlapping with the column wiring 2, and any portions of the resistive film 8 where distances from the connection portions 13 on the resistive film 8 are less than $(\mu(|V1-V2|)t)^{1/2}$ do not overlap with the column wiring 2. As a result, an orbit of electrons emitted from the electron emitting devices 5 can be stabilized, and power consumption can be reduced. This is described below in detail.

Covering of the column wiring 2 with the insulating layer 3 can prevent generation of line defects as described above. However, charging occurs on the surface of the insulating layer 3, creating a new problem of an unstable orbit of electron beams emitted from the electron emitting devices 5. Thus, the resistive film 8 is provided to cover the insulating layer 3. The resistive film 8 is connected to the row wiring 4 to function as an antistatic film, thereby suppressing the charging on the surface of the insulating layer 3, and stabilizing the orbit of the electron beams. Even when the discharging occurs between the anode 45 and the resistive film 8, flowing of a discharge current through the column wiring 2 higher in resistance than the row wiring 4 can be suppressed as the resistive film 8 is connected to the row wiring 4.

However, when the resistive film 8 connected to the row wiring 4 covers the insulating layer 3 while partially overlapping with the column wiring 2, a charge current flows according to a capacity generated between the resistive film 8 and the column wiring 2, resulting in consumption of power. However, since it is the resistive film 8 that overlaps with the column wiring 2 sandwiching the insulating layer 3, it takes time for the charge current to flow in the resistive film 8. Thus, power is not necessarily consumed in proportion to an area overlapping with the column wiring 2. This is described below in detail.

Figure 2B:
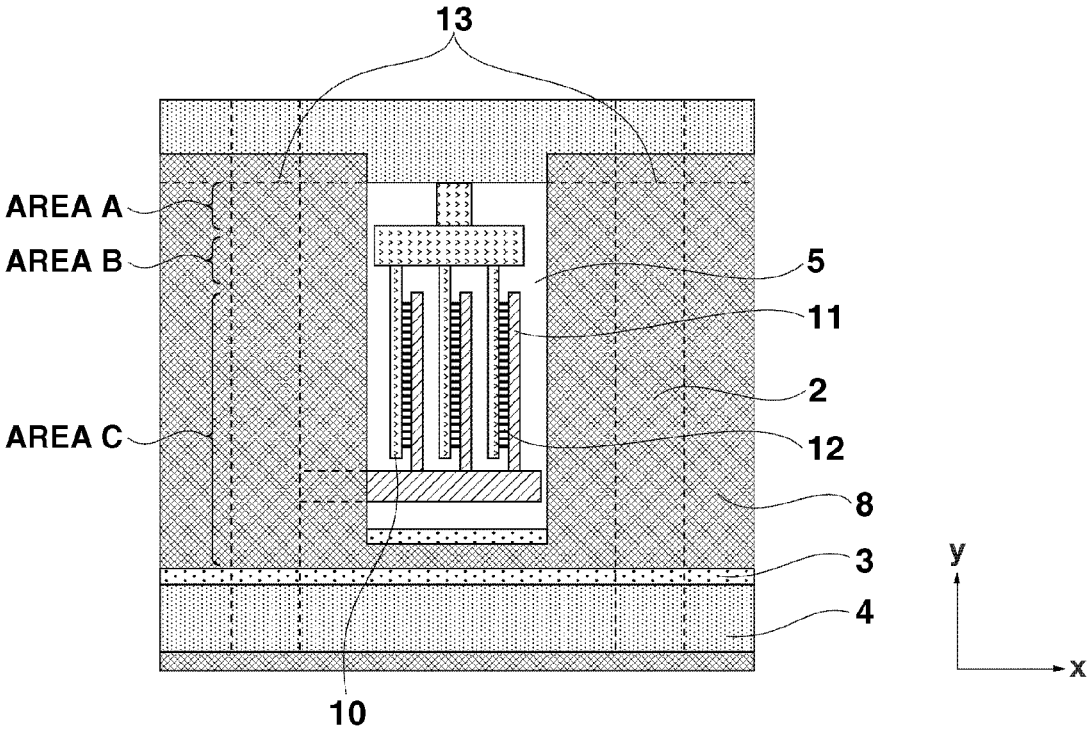
Figure 3A:
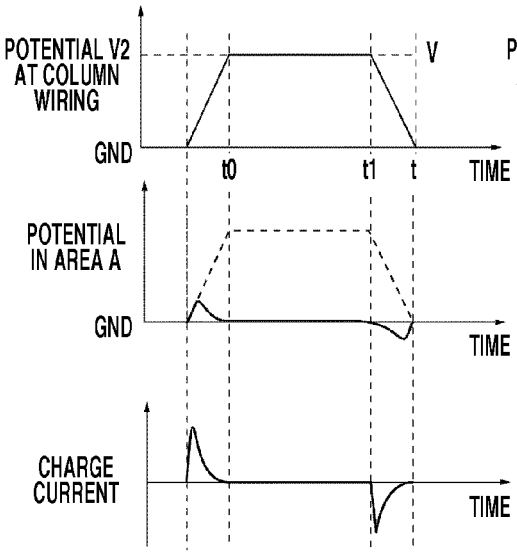
FIGS. 3A to 3D illustrate potentials and charge currents in respective portions of a resistive film.
Figure 3B:
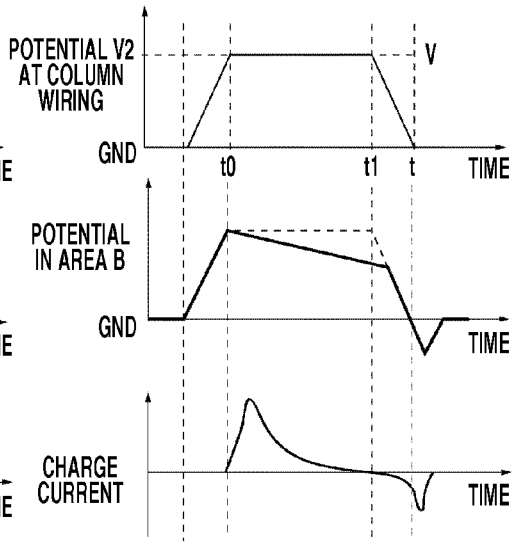
Figure 3C:
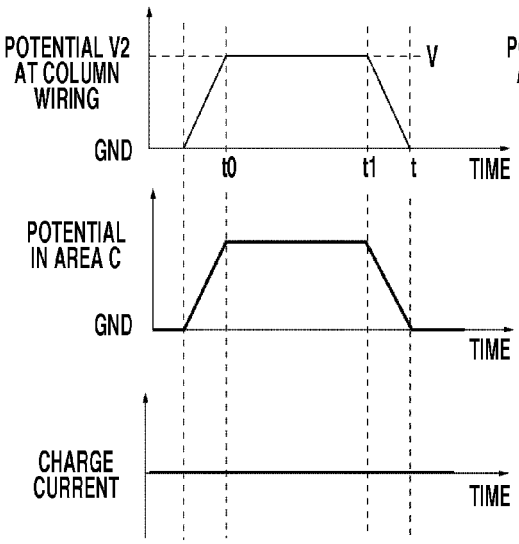
Figure 3D:
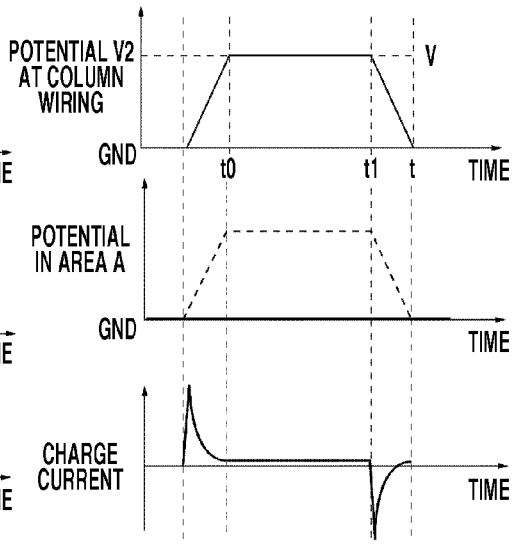

FIG. 2B illustrates a rear plate that includes, as in the case illustrated in FIG. 2A, a resistive film 8 formed on an insulating layer 3 covering a column wiring 2. A configuration is different from that illustrated in FIG. 2A in that the resistive film 8 overlaps with the column wiring 2 even near connection portions 13 of the resistive film 8 to a row wiring 4, specifically, within a range where distances from the connection portion 13 are less than $(\mu(|V1-V2|)t)^{1/2}$ (hereinafter, areas A and B). FIGS. 3A to 3C schematically illustrate states of changes of potentials with time in areas A to C of the resistive film 8 when the second potential V2 is supplied to the column wiring 2 for a predetermined period of time t. The areas A and B are areas of the resistive film 8 adjacent to the connection portion 13 of the resistive film 8 to the row wiring 4, where distances L from the connection portion 13 through the resistive film 8 do not satisfy the expression 1 (less than $(\mu(|V1-V2|)t)^{1/2}$). The area B is located farther from the row wiring 4 than the area A. The area C is an area of the resistive film 8 adjacent to the area B, where a distance L from the connection portion 13 to the row wiring 4 through the resistive film 8 is equal to or more than $(\mu(|V1-V2|)t)^{1/2}$. FIG. 3D illustrates a state of a change of a potential with time at a conductor in a configuration where the insulating layer 3 is covered with the conductor in place of the resistive film 8 illustrated in FIG. 2B. The potential at the conductor exhibits the same behavior in all areas of the conductor. Each figure illustrates a potential of the column wiring 2 at an upper graph, a potential of the resistive film 8 or the conductor at a middle graph, and a charge current flowing through the resistive film 8 or the conductor at a lower graph. For easier description, the first potential V1 supplied to the row wiring 4 is set at a ground (GND) potential.

As illustrated in FIG. 3D, even when the potential V2 is supplied to the column wiring 2, the potential of the conductor is maintained without any changes at GND potential that is the row-wiring potential V1. This is because the conductor is extremely low in resistance, and functions as an electrode, even when the potential V2 supplied to the column wiring 2 causes dielectric polarization in the insulating layer 3, as illustrated at the lower graph. Therefore, a charge current of a corresponding electron amount is quickly supplied from the row wiring 4. As a result, without any changes in potential of the conductor, the potential of the conductor is maintained at the GND potential that is the potential V1 of the row wiring 4.

On the other hand, as illustrated in FIG. 3A to 3C, in the resistive film 8, when the potential V2 is supplied to the column wiring 2, under the influence of the dielectric polarization in the insulating layer 3, the potentials in all areas of the resistive film 8 change following the potential V2 supplied to the column wiring 2. Among these areas, as illustrated in FIG. 3A, a potential of a portion of the area A adjacent to the column wiring 2 slightly changes, following a change in potential of the column wiring 2, for a short period of time, specifically, before the potential of the column wiring 2 reaches its highest potential V2max (before the time reaches t0). However, as this portion is near the connection portion to the row wiring 4, electrons are quickly supplied as illustrated at the lower graph, and the state is stabilized at the GND potential within the time t0. A potential in the area B (potential in the center of the area B) rises up to V2max following the change in potential of the column wiring 2 as illustrated in FIG. 3B. However, electrons supplied from the row wiring 4 arrive as illustrated at the lower graph, and the potential begins to gradually fall toward the GND potential.

After having fallen as in the case of the potential V2 in synchronization with completion of supplying of the potential V2 to the column wiring 2, the potential reaches the GND potential. As illustrated in FIG. 3C, a potential in an arbitrary place of the area C rises to the potential V2max following the change in potential of the column wiring 2, and is maintained at a level equal to that of the column wiring 2. Then, the potential is similarly changed in synchronization with falling of the potential V2 of the column wiring 2 to reach the GND potential. In other words, in the area C, fluctuation in potential is the same as that of the potential V2 of the column wiring 2. This is because in the area C, electrons supplied from the row wiring 4 have not arrived within a supply period (time t) of the potential V2 to the column wiring 2 as illustrated at the lower graph.

In the resistive film 8 of the area C, therefore, neither any potential difference with the column wiring 2 is generated, nor any charge current flows, within the supply period of time t of the potential V2 to the column wiring 2 resulting in no power consumption. Thus, when it is the resistive film 8 serving as the resistor that overlaps with the column wiring sandwiching the insulating layer 3, potential fluctuation is different from that of the conductor, and hence power consumption which occurs in the overlapping area with the column wiring 2 may not occur. Extensive studies have found that surface resistance of the resistive film 8 exhibiting potential fluctuation different from that of the conductor is $10^8\Omega/\square$ or more.

Thus, the present exemplary embodiment provides a structure capable of suppressing power consumption based on a capacity between the resistive film 8 and the column wiring 2 while suppressing the charging on the surface of the insulating layer 3, by limiting places to cover the insulating layer 3 with the resistive film 8 only to the area C that satisfies the expression 1 as illustrated in FIG. 2A, in other words, preventing overlapping of the resistive film 8 with the column wiring 2 in the areas A and B. Next, a length of the area C is described together with fluctuation in potential distribution with time in the resistive film 8.

Figure 4A:
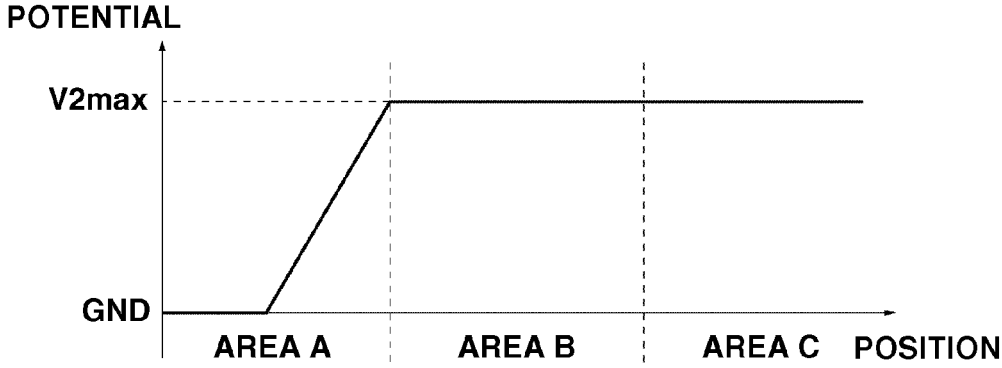
FIGS. 4A to 4C illustrate potentials alteration of time in respective portions of the resistive film.
Figure 4B:
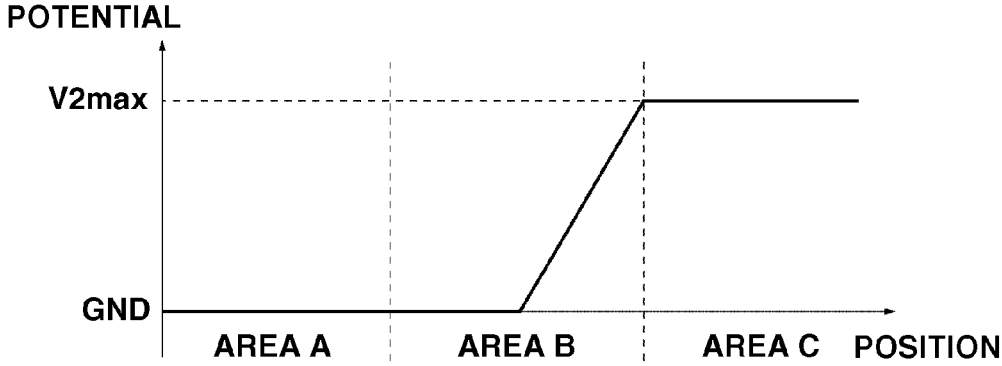
Figure 4C:
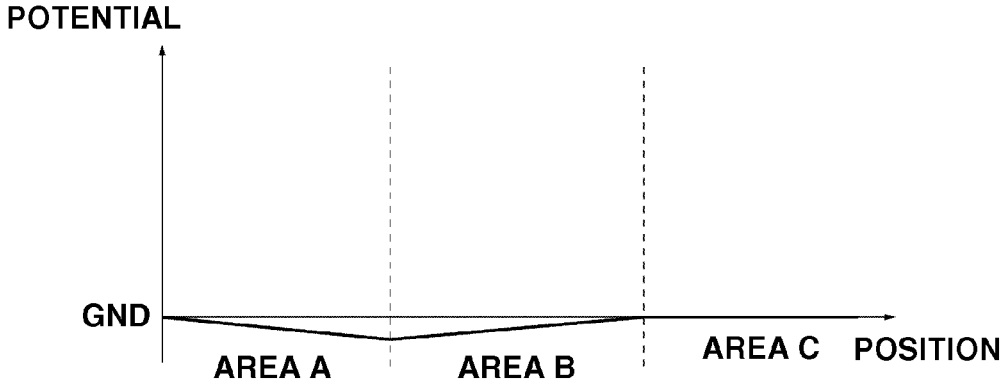

FIGS. 4A to 4C illustrate potential distributions in the resistive film 8 of the configuration illustrated in FIG. 2B when the potential V2 is supplied to the column wiring 2: a vertical axis indicating a potential in the resistive film 8, and a horizontal axis indicating a length of the resistive film 8 from the connection portion 13 to the row wiring 4. FIG. 4A illustrates a potential distribution in the resistive film 8 at time when the potential V2 supplied to the column wiring 2 reaches its highest potential V2max (t0 in FIGS. 3A to 3D). FIG. 4B illustrates a potential distribution in the resistive film 8 at time when the potential V2 supplied to the column wiring 2 begins falling from the highest potential V2max to the GND potential (t1 in FIGS. 3A to 3D). FIG. 4C illustrates a potential distribution in the resistive film 8 at time when supplying of the potential V2 to the column wiring 2 is completed (t in FIGS. 3A to 3D).

As described above and illustrated in FIGS. 4A to 4C, the potential in the resistive film 8 changes from the GND potential to the potential V2 of the column wiring 2 under the influence of the dielectric polarization in the insulating film 3 based on the potential supplied to the column wiring 2. As illustrated in FIG. 4A, at the time t0 when the potential V2 of the column wiring 2 reaches the highest potential V2max, in the area A adjacent to the connection portion to the row wiring 4, electrons supplied from the row wiring 4 have begun to arrive, and hence the potentials have begun to return to the GND potentials at some places adjacent to the column wiring 2. In other words, a potential difference with the potential V2 of the column wiring 2 is generated. On the other hand, in the areas B and C, since no electrons supplied from the row wiring 4 have arrived, the potential remains at V2. At the time t1 when the potential V2 of the column wiring 2 begins falling from V2max to the GND potential, as illustrated in FIG. 4B, potentials have returned to the GND potentials in all the places of the area A.

In the area B, electrons supplied from the row wiring 4 have begun to arrive, and potentials have begun to return to the GND potentials in some places. On the other hand, in the area C, since no electrons supplied from the row wiring 4 have arrived, the potential remains at the highest potential V2max which is the same as the potential V2 of the column wiring 2. At the time t when the supplying of the potential to the column wiring 2 is completed, as illustrated in FIG. 4C, in the areas A and B, discharging of excess electrons supplied from the row wiring 4 to counter the dielectric polarization in the insulating layer 3 based on the potential fluctuation of the column wiring 2 has not been completed, and hence the potential changes slightly to minus. In the area C, since no electrons supplied from the row wiring 4 have been received, the potential remains at the original GND potential.

Thus, the areas A and B receive new electrons supplied from the row wiring 4 to counter the dielectric polarization in the insulating layer 3 during the supplying of the potential to the column wiring 2, while the area C has received no new electrons as electrons supplied from the row wiring 4 have not arrived. Whether electrons arrive supplied from the row wiring 4, is determined by a moving distance of the supplied electrons through the resistive film 8. The moving distance depends on a speed of the electrons moving through the resistive film 8 and transit time. Specifically, a moving distance $(\mu(|V1-V2|)t)^{1/2}$ of the supplied electrons is acquired using mobility μ of the resistive film 8, a potential difference |V1−V2| between the row wiring 4 and the column wiring 2, and generation time t of the potential difference |V1−V2|. Therefore, a length L from the connection portion 13 of the resistive film 8 to the row wiring 4, to the area C only needs to satisfy the following relationship.

$$L \geqq (\mu(|V1-V2|)t)^{1/2} \quad \text{(expression 1)}$$

Thus, power consumption can be suppressed while charging on the surface of the insulating layer 3 is suppressed.

In the image display apparatus, the generation time t of the potential difference |V1−V2| may change depending on a displayed image. Specifically, a display apparatus that employs a pulse-width modulation system for controlling luminance of a displayed image based on a driving period of time of the electron emitting device is one example of the image display apparatus. In this case, the expression 1 is calculated by a maximum value of t.

Next, each component according to the present exemplary embodiment is described. The components of the rear plate 30 are first described.

The back substrate 1 should advisably have strength to mechanically support the electron emitting devices 5, the row wiring 4 that is the first wiring, and the column wiring 2 that is the second wring line, and should show resistance to an alkali or an acid used for a dry etching, wet etching or used as developing solution. Thus, for the back substrate 1, quarts glass, a laminate having an impurity content such as Na reduced, or ceramics such as alumina can be used. According to the present exemplary embodiment, a high strain point glass such as PD200 is suitably used.

The cathode 10 and the gate 11 that constitute the pair of electrodes should advisably be made of materials having high thermal conductivity and high melting-point in addition to excellent electric conductivity. For such materials, a metal such as Be, Mg, Ti, Zr, Hf, V, Nb, Ta, Mo, W, Al, Cu, Ni, Cr, Au, Pt or Pd, or an alloy material can be used. Furthermore, carbide such as TiC, ZrC, HfC, TaC, SiC, or WC can be used. Additionally boride such as $HfB_2$, $ZrB_2$, $CeB_6$, $YB_4$, or $GbB_4$, nitride such as TaN, TiN, ZrN, or HfN, or semiconductor such as Si or Ge can be used. A carbon such as amorphous carbon, graphite, diamond-like carbon, or diamond or a carbon compound such as an organic polymer material, or those carbon dispersed in can also be used. As a method for forming the electrodes, a general vacuum deposition technique such as vapor deposition or sputtering can be used.

For the electron emitting unit 12, any material that not only has high electrical conductivity but also is capable of field emission can be used. Generally, a material having a high melting-point equal to or more than 2000° C. and a work function of 5 electron volts or less, which is hard to form a chemical reaction layer such as an oxide, can be used. For such a material, a metal such as Hf, V, Nb, Ta, Mo, W, Au, Au, Pt, or Pd, or an alloy material can be used. A carbide such as TiC, ZrC, HfC, TaC, SiC, or WC, a boride such as $HfB_2$, $ZrB_2$, $CeB_6$, $YB_4$, or $GdB_4$, or a nitride such as TiN, ZrN, HfN, or TaN can also be used. Carbon in which amorphous carbon, graphite, diamond-like carbon, or diamonds are dispersed, or a carbon compound can also be used. As a method for forming the electron emitting unit, the general vacuum deposition technique such as vapor deposition or sputtering can be used.

As long as materials are conductive such as metals, there is no particular limitation on materials for the row wiring 4 that is the first wiring and the column wiring 2 that is the second wiring. As a method of forming the wirings, a printing method or a coating method by a dispenser can be used. The column wiring 2 that is the second wiring can be higher in resistance than the row wiring 4 that is the first wiring by setting a width and a thickness smaller and using a material lower in conductivity than the row wiring 4.

For the insulating layer 3, a material resistant to a high electric field is preferable. For example, an oxide such as $SiO_2$ or a nitride such as $SiN_4$ can be used. The insulating layer 3 can be formed by general vacuum deposition such as sputtering, chemical vapor deposition (CVD), or vacuum vapor deposition.

For the resistive film 8, as described above, there is no particular limitation on a material as long as surface resistance can be set to $10^8\Omega/\square$ or more. A material having low mobility is recommended. For example, a semiconductor material such as amorphous silicon or carbon can be used.

Next, components of the face plate 46 are described.

For the front substrate 43, a member such as glass that transmits visible light can be used. In the present exemplary embodiment, a high strain point glass such as PD200 is suitably used. For the light emitting member 44, a phosphor crystal that is excited by an electron beam to emit light can be used. As a specific phosphor material, a phosphor material used in a conventional cathode ray tube (CRT), for example, the one described in "Phosphor Handbook" by Phosphor Society (published by Ohmsha, Ltd.), can be used.

For the anode 45, a metal back made of Al, which is known in the CRT can be used. To pattern the anode 45, vapor deposition method via a mask or etching method can be used. A thickness of the anode 45 is appropriately set in view of an electron energy loss, a set acceleration voltage (anode voltage), and light reflection efficiency, since electrons must pass through the anode 45 to reach the light emitting member 44.

In the present exemplary embodiment, as illustrated in FIG. 1, as a preferred form, a light shielding member 48 is provided between the light emitting members 44 adjacent to each other.

The light shielding member 48 can employ a black matrix structure well-known in the CRT, which generally contains a black metal, a black metal oxide, or carbon. Examples of the black metal oxide are a ruthenium oxide, a chromium oxide, an iron oxide, a nickel oxide, a molybdenum oxide, a cobalt oxide, and a copper oxide.

Rim portions of the face plate 46 and the rear plate 30 are joined together via a frame member 42 to construct the image display apparatus 47.

To display an image by the image display apparatus 47, a potential Va higher than those of the electron emitting devices is supplied via a high-voltage terminal HV, and different potentials are supplied to the row wiring 4 and the column wiring 2 via terminals Dx and Dy. A driving voltage is applied to the electron emitting devices 5 to emit electrons from an arbitrary electron emitting device 5. The electrons emitted from the electron emitting device 5 are accelerated to collide with the light emitting members 44. Thus, the light emitting member 44 is selectively excited to emit light, thereby displaying the image.

Hereinafter, Example 1 of the present invention is described. In the Example 1, an image display apparatus was constructed using the rear plate 30 including the electron emitting devices illustrated in FIG. 2A. An overall configuration of a face plate and the image display apparatus is similar to that of the abovementioned embodiment, and thus only characteristic portions of the Example 1 are described. In the Example 1, because of excellent electron emission characteristics, vertical electron emitting devices are used, where an insulating member is stacked on a back substrate 1, electron emitting units are formed on side faces, and a gate is formed on a top surface. However, the present invention is not limited to the vertical electron emitting devices.

FIGS. 5A to 5E and FIGS. 6F to 6H illustrate a process for forming the rear plate according to the present exemplary embodiment. The process is described step by step. FIGS. 5A to 5E and FIGS. 6F to 6H illustrate cross-sections at each step in a position of an XX' line.

Figure 5A:
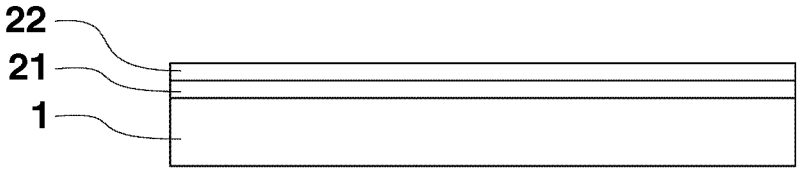
FIGS. 5A to 5E are partial sectional views illustrating parts of a manufacturing process of an electron emitting device according to an exemplary embodiment of the present invention.

First, as illustrated in FIG. 5A, for the back substrate 1, a soda-lime glass was prepared, and sufficiently cleaned. A $Si_3N_4$ film was then deposited with a thickness of 300 nanometers as an insulating layer 21 by sputtering. A $SiO_2$ film was deposited with a thickness of 20 nanometers as an insulating layer 22 by sputtering.

Figure 5B:
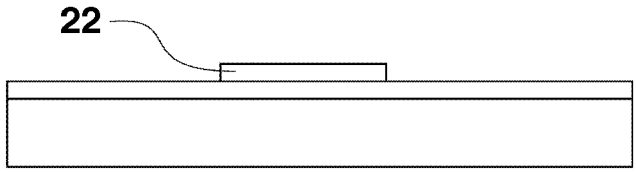

As illustrated in FIG. 5B, a positive photoresist was applied on the entire surface by spin coating, and then exposed and developed to form a resist pattern. The insulating layer 22 was patterned using the patterned photoresist as a mask.

Figure 5C:
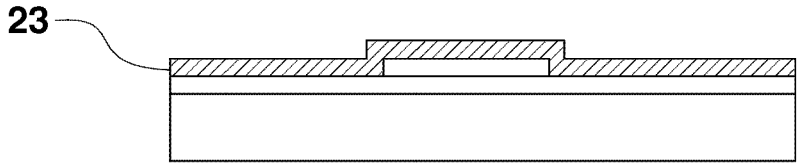

As illustrated in FIG. 5C, a TaN film was deposited with a thickness of 30 nanometers as a conductive layer 23 by sputtering.

Figure 5D:
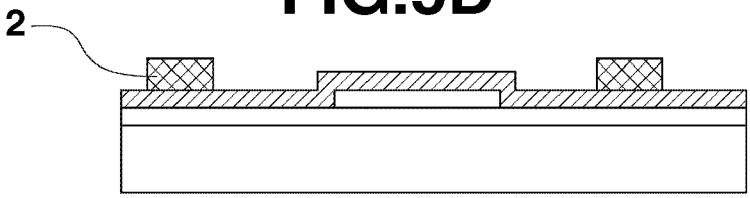

As illustrated in FIG. 5D, a Cu film was deposited with a thickness of 3 micrometers by sputtering. A positive photoresist was applied on the entire surface by spin coating, and then exposed and developed to form a resist pattern. The Cu film was etched with an etching solution using the patterned photoresist as a mask to form a column wiring 2 with a width of 20 micrometers.

Figure 5E:
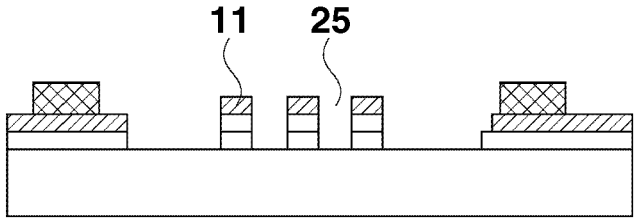

As illustrated in FIG. 5E, a positive photoresist was applied by spin coating, and then exposed and developed to form a resist pattern. The insulating layer 21, the insulating layer 22, and the conductive layer 23 were patterned by dry etching using $CF_4$ gas with the patterned photoresist as a mask. Thus, openings 25 were formed, and gates 11 made of TaN were formed on the insulating members 22 and conductive members 23.

Figure 6F:
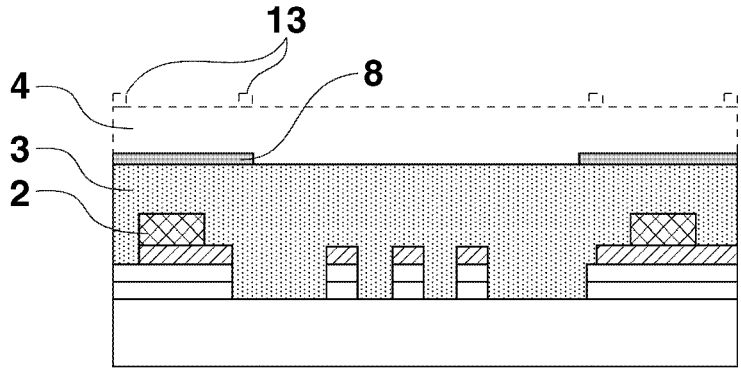
FIGS. 6F to 6H are partial sectional views illustrating other parts of the manufacturing process of the electron emitting device according to an exemplary embodiment of the present invention.

Then, as illustrated in FIG. 6F, a SiO2 film was deposited with a thickness of 3 micrometers on the entire substrate surface to form an insulating layer 3 by CVD. A Cu film was deposited with a thickness of 10 micrometers on the insulating layer 3 by electrolytic plating. A positive photoresist was applied on the Cu film by spin coating, and then exposed and developed to form a resist pattern. The Cu film was etched by an etching solution to form a row wiring 4 with a width of 250 micrometers using the patterned photoresist as a mask. A negative photoresist was applied on the row wiring 4 by spin coating, and then exposed and developed to form a resist pattern. Amorphous silicon was deposited with a thickness of 100 nanometers on the resist pattern. The resist pattern was peeled off to form amorphous silicon resistive films 8 that prevent charging. The resistive films 8 were stacked on the row wiring 4 at portions not overlapping with the column wiring 2 to form connection portions 13 to the row wiring 4. The row wiring 4 and the connection portions 13 of the resistive films 8 located thereon are indicated by broken lines.

Figure 6G:
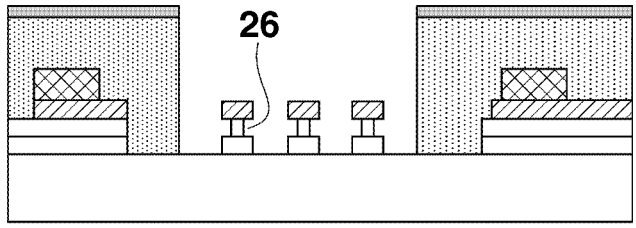

As illustrated in FIG. 6G, an area of the $SiO_2$ film formed in the previous step surrounded with the row wiring 4 and the column wiring 2 adjacent to each other was selectively etched to pattern the insulting layer 3. For an etching solution, a buffer hydrofluoric acid (BHF) (LAL 100/manufactured by STELLA CHEMIFA CORPORATION) was used, and an etching time was 11 minutes. The side faces of the insulating layer 22 in the openings 25 were simultaneously etched by about 60 nanometers to form notches 26.

Figure 6H:
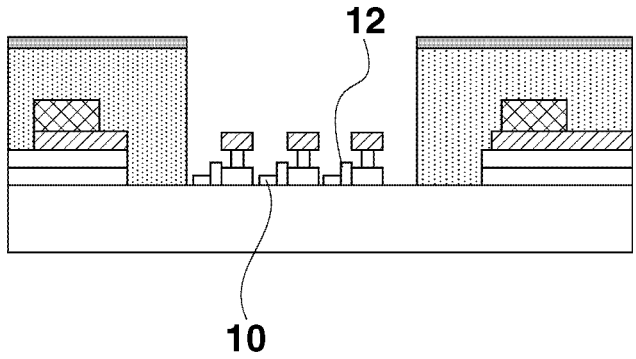

As illustrated in FIG. 6H, by oblique vapor deposition, Mo was deposited with a thickness of 30 nanometers on the side faces of the insulating layer 21 obliquely from the upper side by 45 degrees. A positive photoresist was applied thereon by spin coating, and then exposed and developed to form a resist pattern. The Mo film was dry-etched using the patterned photoresist as a mask and $CF_4$ gas to form cathode electrodes 10 and electron emitting units 12.

The image display apparatus illustrated in FIG. 1 was manufactured using the rear plate thus constructed, and by the method according to the abovementioned exemplary embodiment. A distance L from the connection portion 13 of the resistive film 8 to a portion overlapping with the column wiring 2 was 260 micrometers, a sheet resistance value of the resistive film was $1\times10^{12}$[Ω/□], and mobility was 1 [$cm^2$/Vsec].

As a comparative example, an image display apparatus was constructed as in the case of the Example 1 except for formation of a resistive film 8 by polycrystalline silicon. Mobility of the acquired resistive film 8 made of the polycrystalline silicon was 80 [$cm^2$/sec].

In the image display apparatus thus constructed, a voltage was applied through the wirings between the cathode electrode 10 and the gate electrode 11 that make a pair. Specifically, a potential applied to the column wiring 2 was +5 volts, a potential applied to the row wiring 4 was −5 volts, and a pulse voltage having a maximum pulse width set to 5 microseconds to output highest luminance was applied. Simultaneously, a direct current high voltage of 10 kilovolts was applied to a metal back 45 of a face plate 46. As a result, $(\mu(|V1-V2|)t)^{1/2}$ became about 70 micrometers. In the image display apparatus according to the Example 1 where the distance from the connection portion 13 of the resistive film 8 to the row wiring 4 to the portion overlapping with the column wiring 2 was 260 micrometers, power consumption at one electron emitting device was sufficiently reduced to $1\times10^{-14}$ watts. There was no disturbance in an image during display, confirming that the image display apparatus has a sufficient antistatic function.

On the other hand, in the image display apparatus according to the comparative example, $(\mu(|V1-V2|)t)^{1/2}$ became about 660 micrometers. In the comparative example where a distance from the connection portion 13 of the resistive film 8 to the row wring line 4 to the portion overlapping with the column wiring 2 was 260 micrometers, power consumption at one electron emitting device increased to $1\times10^{-12}$ watts compared with the Example 1. With a passage of driving time, a spot spreading state of electron beams emitted from the electron emitting devices was observed. Thus, it was confirmed that the configuration of the Example 1 can reduce power consumption and provide good displayed image.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-003028 filed Jan. 8, 2010, which is hereby incorporated by reference herein in its entirety.

What is claimed is:

1. An image display apparatus comprising:

a rear plate including:

a plurality of electron emitting devices each including a pair of electrodes and an electron emitting unit located between the pair of electrodes, the plurality of electron emitting devices being arrayed in a matrix;

a plurality of first wirings each configured to interconnect electrodes in one of the pair of electrodes of the electron emitting devices arrayed at the same row among the plurality of electron emitting devices;

a plurality of second wirings each configured to interconnect electrodes in another of the pair of electrodes of the electron emitting devices arrayed at the same column among the plurality of electron emitting devices and higher in resistance than the first wirings;

an insulating layer configured to cover the second wirings; and resistive films connected to the first wirings and partially overlapping with the second wirings to cover the insulating layer, and having surface resistance set to $10^8\Omega/\square$ or more;

a potential supply unit configured to supply a first potential V1 and a second potential V2 different from the first potential V1 respectively to the first wirings and the second wirings; and a face plate including an anode set at a potential higher than the first potential and the second potential, and light emitting members to be irradiated with electrons emitted from the electron emitting devices to emit light, wherein the resistive films are connected to the first wirings at portions not overlapping with the second wirings, and a length L of the resistive film between a portion of the resistive film connected to the first wiring and a portion overlapping with the second wiring satisfies the following relationship:

$$L \geqq (\mu(|V1-V2|)t)^{1/2}$$

where μ is an electron mobility of the resistive film, and t is a period of time of supplying the potential V1 and the potential V2.

2. The image display apparatus according to claim 1, wherein the resistive film is an antistatic film.

* * * * *